US005334052A

United States Patent [19]

Chen

[11] Patent Number: 5,334,052

[45] Date of Patent: Aug. 2, 1994

[54] RECEPTACLE

[75] Inventor: Chao-Hsiung Chen, Tainan, Taiwan

[73] Assignee: Ma Chi Electric Apparatus Ent. Co., Ltd., Tainan, Taiwan

[21] Appl. No.: 70,695

[22] Filed: Jun. 2, 1993

[51] Int. Cl.[5] ..... H01R 25/00

[52] U.S. Cl. ..... 439/650; 439/540

[58] Field of Search ..... 439/650–655, 439/110, 113, 207–212, 535, 536, 540

[56] References Cited

U.S. PATENT DOCUMENTS 3,049,688 8/1962 Sinopoli ..... 439/650
3,744,010 7/1973 Meacham ..... 439/650
4,582,383 4/1986 Jo et al. ..... 439/650
4,909,758 3/1990 Woods ..... 439/650

*Primary Examiner*—David L. Pirlot
*Attorney, Agent, or Firm*—Morton J. Rosenberg; David I. Klein

[57] ABSTRACT

A telephone connecting socket to be fixed in a wall for a connecting plug of a telephone to fit in a hole in the socket having a front cap, a body and a rear cap, the front cap covering a front portion of the body and the rear cap covering a rear half portion of the body, the front cap having an opening normally closed up with a shield elastically pushed by a coil spring, the body having an inner socket with a hole for the connecting plug of a telephone to fit therein by passing through the opening in the front cap with the shield pushed open.

5 Claims, 3 Drawing Sheets

RECEPTACLE

BACKGROUND OF THE INVENTION

A conventional receptacle used for an extension cord i with a plug 11 and an electric wire 12 shown in FIG. 7 includes a plurality of sockets 13 fitted in holes in an upper cap 14 and a bottom plate 15 combined with the cap 14 with a screw 16.

However, this conventional receptacle is considered to have the following drawbacks.

1. The upper cap and the bottom plate are made of plastic with a mold by injecting process, so a maker has to prepare a plurality of molds for making receptacles of different sizes and shapes, to a resultant high cost in manufacture.

2. The upper plate and the bottom plate are combined together with a screw, so a driver has to be used in case of checking the receptacle or fixing electric wires on it.

SUMMARY OF THE INVENTION

This invention has been devised to offer a kind of receptacle having the following advantages.

1. A bottom plate and a face plate of the receptacle are made of a long narrow aluminum plate manufactured by extracting process, by cutting the material into a needed length and boring holes in them by pressing process, without using molds in making a variety of receptacles of different sizes and shapes, to economize the cost.

2. Its components such as the bottom plate, the face plate, etc, are assembled together by means of grooves and projections without using screws or bolts, so it does not need any tools in taking it apart for checking or wiring.

3. It has two hangers for keeping it from moving, even if it is placed on flat horizontal surface, not just as a conventional one is moved carelessly.

BRIEF DESCRIPTION OF DRAWINGS

The invention will be better understood by reference to the accompanying drawings, wherein.

DESCRIPTION OF THE PREFERRED EMBODIMENTS

Figures 1, 2, 3:
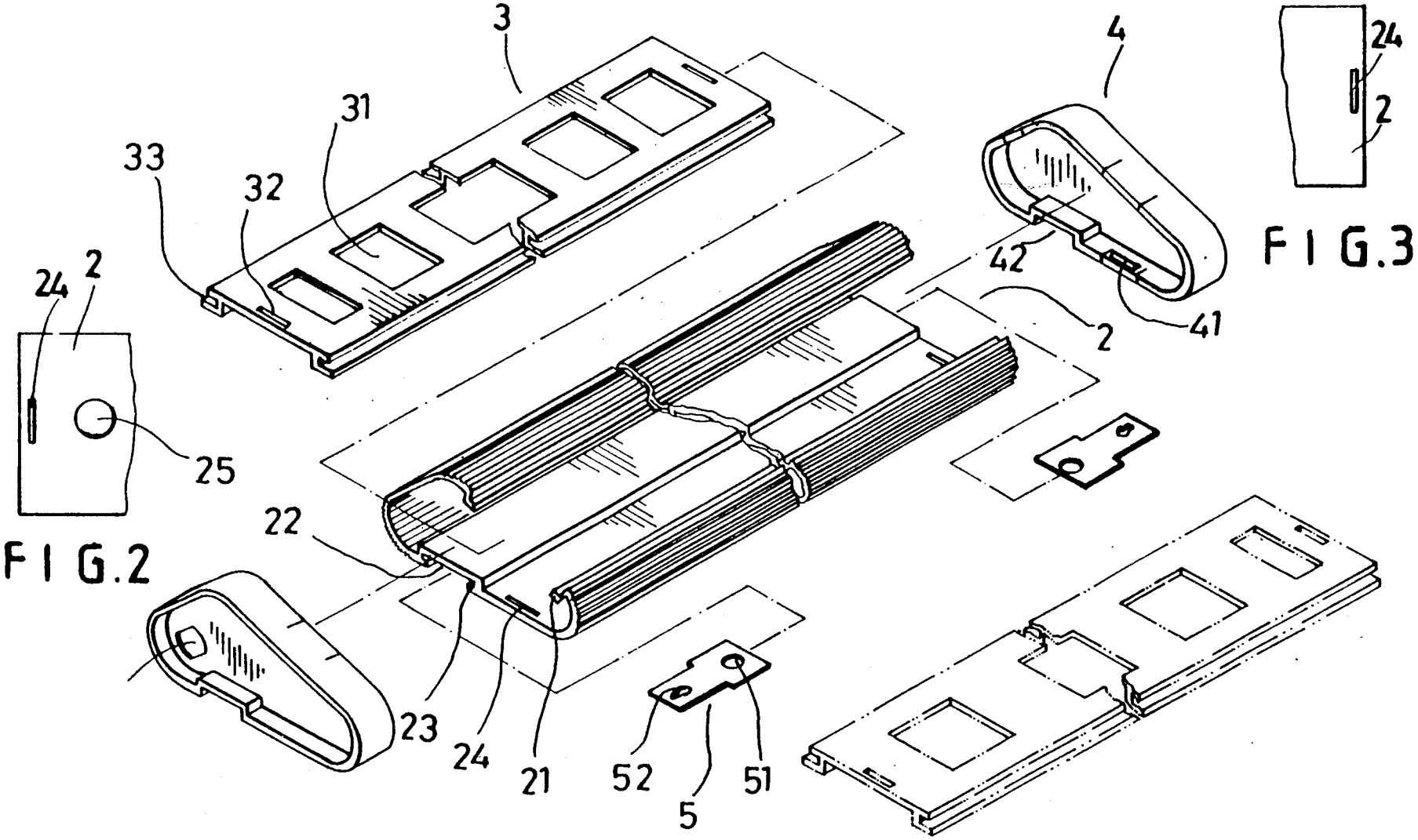
FIG. 1 is an exploded perspective view of a receptacle in the present invention.
FIG. 2 is a cut-away plan view of a portion of the bottom base of the present invention.
FIG. 3 is a cut-away plan view of another portion of the bottom base of the present invention.
Figure 6:
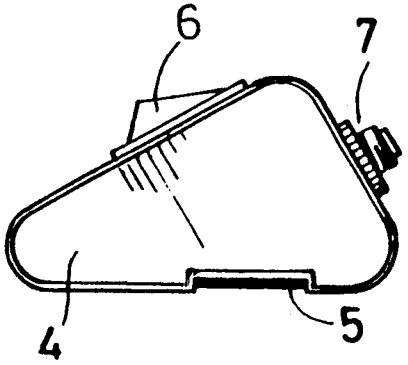
FIG. 6 is a right side view of the receptacle in the present invention.
Figure 4:
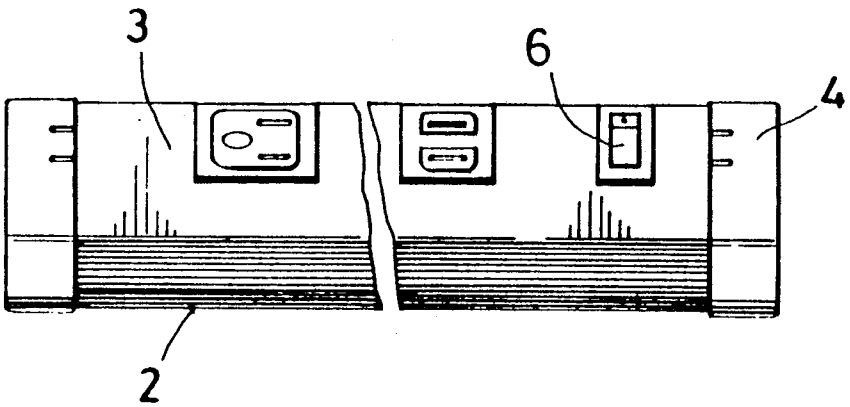
FIG. 4 is a front view of the receptacle in the present invention.
Figure 5:
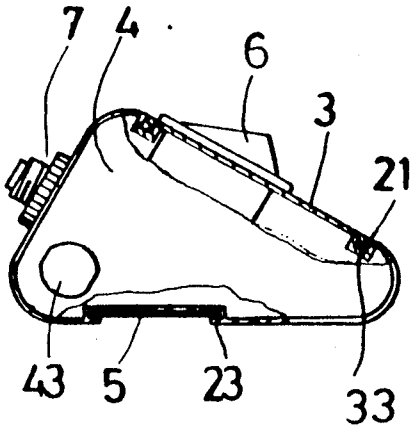
FIG. 5 is a left side view of the receptacle partially cut-away.
Figure 7:
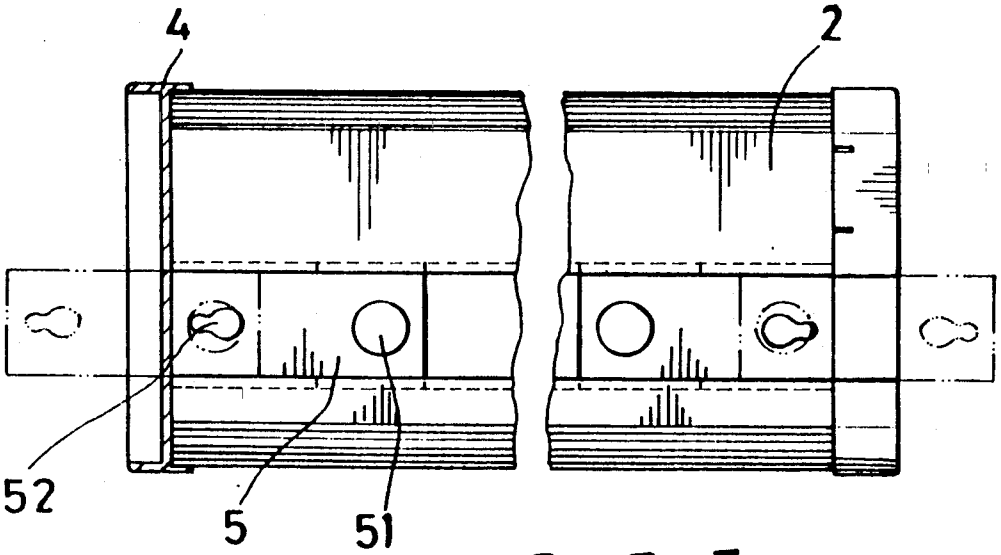
FIG. 7 is a rear view of the receptacle in the present invention, showing hangers to be assembled therein.
Figure 9:
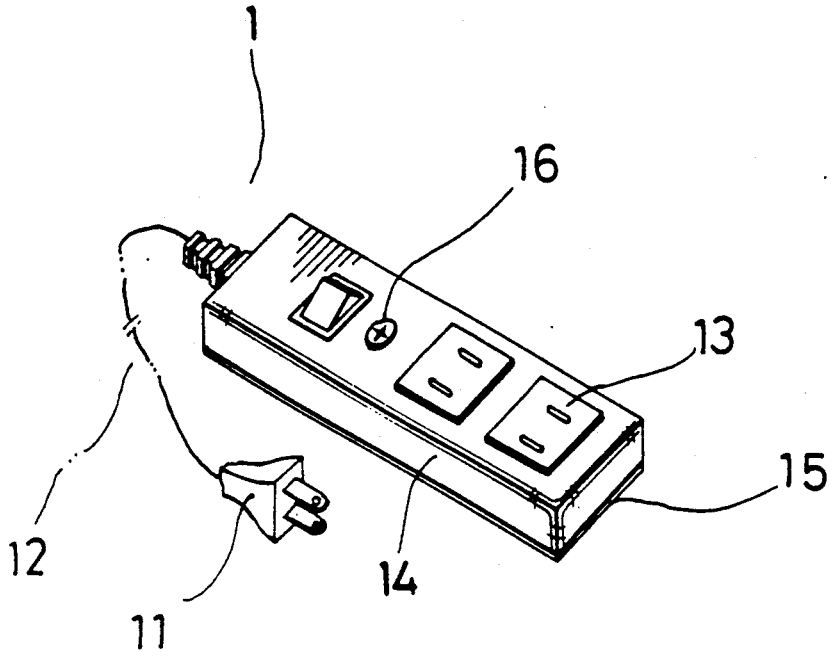
FIG. 9 (PRIOR ART)

A receptacle in the present invention, as shown in FIG. 1, includes a bottom base 2, a face plate 3, two side caps 4, 4 and two hangers 5, 5.

The bottom base 2 is shaped as rectangular, having two opposite longitudinal sides curved up to define an upper longitudinal opening, each curved-up side having a projecting ridge 21 a little concaved, a longitudinal recess 22 in a bottom surface and a projecting edge 23 on both longitudinal sides of the recess 22, a slot 24 respectively in two lateral opposite sides and a hole 25 in a proper point in the base 2.

The face plate 3 is made of aluminum plate, shaped rectangular, having a plurality of combining holes 31, two slots 32, 32 respectively in two lateral opposite ends, and a longitudinal groove 33 respectively in two longitudinal opposite sides.

The side caps 4, 4 have respectively two elastic members 41, 41 on an inner wall, a recess 42 to correspond to the recess 22 of the bottom base 2, and one of the side caps 4 has a hole 43 in a proper place in a lateral wall for a power cord to pass through.

The two hangers 5, 5 are shaped as T, having a hole 51 for sliding and a locating hole 52.

In assembling, as shown in FIGS. 2–7, first plurality of switches and sockets 6 are fixed in the combining holes 31 of the face plate 3, then the face plate 3 is placed in an open side of the bottom base 2, with the longitudinal grooves 33, 33 fitting with the projecting ridges 21, 21 of the bottom base 2. After that, a security component 7 such as a fuse is inserted in the hole 25. And the hangers 5, 5 are inserted in two end portions of the recess 22, with their opposite sides fitting in the projecting edges 23, 23. Lastly, the two side caps 4, 4 are respectively deposited to close each of the two open sides of the bottom base 2 combined with the face plate 3, with the two elastic members 41, 41 of each side cap 4 fitting in two slots 24, 32 of the bottom base 2 and the face plate 3. A power cord is provided to pass through the hole 3 to go in the interior of this receptacle.

Figure 8:
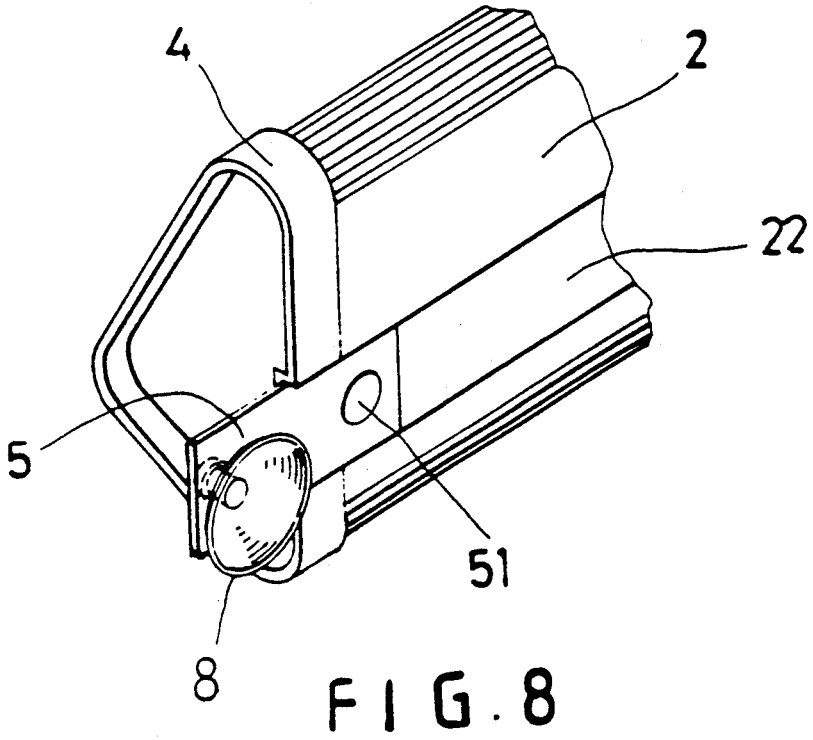
FIG. 8 is a perspective view of the receptacle in the present invention, to be hung on a wall with a suction disc; and, FIG. 9 is a perspective view of a conventional receptacle.

In using, this receptacle can be placed on any flat surface, or hung on a vertical flat wall with one of the hangers 5 pulled to protrude out of one end of the recess 22 of the bottom base 2 and with the locating hole 52 hung on a nail, a screw or a suction disc 8, as shown in FIG. 8.

While the preferred embodiments of the invention have been described above, it will be recognized and understood that various modifications may be made therein and the appended claims are intended to cover all such modifications which may fall within the spirit and scope of the invention.

What is claimed is:

1. A receptacle at least comprising:

a bottom base of a long rectangular shape, having two longitudinal sides curved up defining a longitudinal opening between them for depositing a face plate therein, each said curved-up side having a longitudinal projecting ridge a little recessed, a slot respectively in a lateral side end;

said face plate of a flat longitudinal shape, deposited in said longitudinal opening of said bottom base, having a plurality of combining holes for combining a plurality of sockets or switches, a longitudinal groove respectively in each of two longitudinal side edges to fit with the two longitudinal projections of said bottom base, and a slot respectively in each of two lateral ends; and, two side caps fitting around and closing two lateral open sides of said bottom base combined with said face plate, having two elastic members on its inner wall to fit in said slots of said bottom base and said face plate, and a hole for a power cord to pass through.

2. The receptacle as claimed in claim 1, wherein said bottom base is provided with a longitudinal recess in its bottom surface and a longitudinal projection at each longitudinal wall defining said recess and said two side caps also having respectively a recess of the same size and shape as that of said bottom base for two hanger having a locating hole to fit and slide therein so as to hang said receptacle on a vertical wall by a screw or a nail or a suction disc.

3. The receptacle as claimed in claim 1, wherein said bottom base is bored with a hole in a proper point for placing a security component such as a fuse.

4. The receptacle as claimed in claim 1, wherein said hangers have a hole serving for pushing.

5. The receptacle as claimed in claim 1, wherein said face plate is preferably made of aluminum.

* * * * *